US008899511B2

(12) United States Patent
Takahashi

(10) Patent No.: US 8,899,511 B2
(45) Date of Patent: Dec. 2, 2014

(54) ROLL MEDIUM SUPPORT DEVICE AND RECORDING DEVICE

(75) Inventor: Yoji Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 740 days.

(21) Appl. No.: 13/042,713

(22) Filed: Mar. 8, 2011

(65) Prior Publication Data

US 2011/0229241 A1 Sep. 22, 2011

(30) Foreign Application Priority Data

Mar. 19, 2010 (JP) ..... 2010-064331

(51) Int. Cl.

| | |
|---|---|
| ***B65H 16/06*** | (2006.01) |
| ***B65H 18/04*** | (2006.01) |
| ***B65H 49/26*** | (2006.01) |
| ***B65H 49/32*** | (2006.01) |
| ***B65H 75/18*** | (2006.01) |
| ***B65H 75/14*** | (2006.01) |
| ***B65H 75/24*** | (2006.01) |
| *B41J 15/04* | (2006.01) |

(52) U.S. Cl.

CPC ..... *B65H 75/14* (2013.01); *B65H 75/241* (2013.01); *B41J 15/042* (2013.01)

USPC ..... 242/598.3; 242/599.4

(58) Field of Classification Search

USPC ..... 242/598, 598.3, 599, 599.3, 596.7

See application file for complete search history.

(56) References Cited

U.S. PATENT DOCUMENTS

| | | | | |
|---|---|---|---|---|
| 5,659,999 | A * | 8/1997 | Benson | 49/404 |
| 7,681,478 | B2 * | 3/2010 | Gerdes et al. | 82/1.11 |
| 8,210,673 | B2 * | 7/2012 | Koike et al. | 347/104 |
| 2008/0018037 | A1 | 1/2008 | Genta | |

FOREIGN PATENT DOCUMENTS

| | | | |
|---|---|---|---|
| JP | 63-857 | U | 1/1988 |
| JP | 2007-008624 | A | 1/2007 |
| JP | 2007-290865 | A | 11/2007 |
| JP | 2009-107773 | A | 5/2009 |

* cited by examiner

*Primary Examiner* — Emmanuel M Marcelo
*Assistant Examiner* — Angela Caligiuri
(74) *Attorney, Agent, or Firm* — Global IP Counselors, LLP

(57) ABSTRACT

A roll medium support device includes a shaft member including an insertion part having a rectangular shape in cross section and configured to be inserted through a center hole of a roll medium, a support member having a rectangular first insertion hole through which the insertion part is inserted so that the support member supports the roll medium from a width direction, a rotating member rotatably provided to the support member and having a rectangular second insertion hole through which the insertion part is inserted, a pair of interlocking members extending along long sides of the second insertion hole in the rotating member, and an urging member urging the interlocking members towards each other. A distance between the interlocking members is shorter than a distance between short-side surfaces of the insertion part and longer than a distance between long-side surfaces of the insertion part.

10 Claims, 8 Drawing Sheets

ROLL MEDIUM SUPPORT DEVICE AND RECORDING DEVICE

CROSS-REFERENCE TO RELATED APPLICATIONS

This application claims priority to Japanese Patent Application No. 2010-064331 filed on Mar. 19, 2010. The entire disclosure of Japanese Patent Application No. 2010-064331 is hereby incorporated herein by reference.

BACKGROUND

1. Technical Field

The present invention relates to a printer or another recording device, for example, and a roll medium support device provided to this recording device.

2. Related Art

Commonly, printers that serve as recording devices for performing a recording process on a roll medium are widely known (Japanese Laid-Open Patent Publication No. 2009-107773, for example). The printer of Japanese Laid-Open Patent Publication No. 2009-107773 comprises a paper width regulating mechanism for guiding a set rolled printing paper (a roll medium) so that the printing paper is conveyed stably without coming off course when printing is initiated. The paper width regulating mechanism comprises a rotating shaft (a shaft member) having protuberances at both ends, a pair of flanged rollers (support members) provided to the outer sides of both protuberances in the rotating shaft, and a pair of compression coil springs which are disposed on the inner sides of both flanged rollers in the rotating shaft and which urge the flanged rollers outward.

The flanged rollers comprise flanges for regulating the side ends of the printing paper, and groove parts having pluralities of grooves corresponding to various paper widths of prescribed sizes, and the flanged rollers are fitted so as to be free to slide and rotate relative to the rotating shaft. The paper width regulating mechanism is designed so that the protuberances are selectively fitted with the respective appropriate grooves from among the groves of the groove parts, so that the distance between the pair of flanges corresponds with the width of the printing paper.

SUMMARY

In the printer of Japanese Laid-Open Patent Publication No. 2009-107773, when the size of the printing paper being used is changed, the positions of the flanged rollers must be changed to match up with the changed printing paper width, but in this case, the protuberances must be fitted with the appropriate grooves by rotating the flanged rollers while pressing the flanged rollers in toward the center of the rotating shaft against the urging force of the compression coil springs. Specifically, the operation of changing the positions of the flanged rollers must be performed constantly against the urging force of the compression coil springs. Therefore, it has been a problem that the operation of changing the positions of the flanged rollers has had poor operability.

The present invention was devised in view of such problems inherent in the prior art. An object thereof is to provide a roll medium support device and a recording device wherein it is possible to improve the operability of changing the positions of support members which are attached to a shaft member and which support a roll medium from the width direction.

To achieve the object described above, a roll medium support device according to a first aspect of the present invention includes a shaft member, a support member, a rotating member, a pair of interlocking members, and an urging member. The shaft member includes an insertion part having a rectangular shape in cross section. The insertion part is configured to be inserted through a center hole of a roll medium. The support member has a rectangular first insertion hole through which the insertion part is inserted so that the support member supports the roll medium from the width direction. The rotating member is rotatably provided to the support member and having a rectangular second insertion hole through which the insertion part is inserted. The interlocking members extend along long sides of the second insertion hole in the rotating member. A distance between the interlocking members is shorter than a distance between short-side surfaces of the insertion part and longer than a distance between long-side surfaces of the insertion part. The urging member urges the interlocking members towards each other.

According to this aspect, there is no load imposed by the urging member when the insertion part of the shaft member is inserted through the first insertion hole of the support member and the second insertion hole of the rotating member so that the long-side surfaces of the insertion part correspond with the interlocking members. When the rotating member is rotated 90 degrees with the support member having been moved to a desired position in the insertion part, the support member is fixed in place at the desired position in the shaft member because the interlocking members press in on the short-side surfaces of the insertion part due to the urging force of the urging member. Therefore, it is possible to improve the operability of changing the position of the support member which is attached to the shaft member and which supports the roll medium from the width direction.

In the roll medium support device as described above, the insertion part of the shaft member preferably includes concave parts formed in the short-side surfaces to engage with the interlocking members.

According to this aspect, by rotating the rotating member 90 degrees with the support member having been moved so that the interlocking members correspond with the concave parts of the insertion part, the interlocking members are engaged with the concave parts while being pressed into the concave parts of the insertion part by the urging force of the urging member. Therefore, the support member can be effectively prevented from moving in the axial direction in the insertion part of the shaft member.

In the roll medium support device as described above, the urging member preferably includes a pair of elastic members extending along short sides of the second insertion hole in the rotating member to connect opposing ends of the interlocking members together.

According to this aspect, the interlocking members can be urged towards each other with a simple structure.

In the roll medium support device as described above, the support member preferably includes a pair of polygonal flanges configured to support the roll medium from both sides in the width direction. Peripheral surfaces of the flanges preferably include markings for disposing the flanges facing each other so that the first insertion holes formed in centers of the flanges align with each other in the width direction of the roll medium.

According to this aspect, by aligning the markings of the flanges with each other, the flanges can easily be disposed facing each other so that the first insertion holes of the flanges coincide with each other in the width direction of the roll medium, even without confirming the flanges from the width direction of the roll medium. Therefore, the shaft member can easily be inserted through the first insertion holes of the flanges.

In the roll medium support device as described above, the shaft member preferably further includes shaft portions configured to be axially supported, the shaft portions extending along an axial direction in centers at both ends in the axial direction of the insertion part.

According to this aspect, in cases in which the shafts of the shaft member are axially supported by bearing members, for example, the shaft member can be prevented from moving in the axial direction by the insertion part, by setting the length of the insertion part so that the bearing members and the end surfaces in the axial direction of the insertion part of the shaft member face each other in close proximity.

A recording device according to another aspect of the present invention includes the roll medium support device as described above, and a recording unit configured to perform a recording process on the roll medium fed out from the roll medium support device.

According to this aspect, the same operational effects as those described above can be achieved.

BRIEF DESCRIPTION OF THE DRAWINGS

Referring now to the attached drawings which form a part of this original disclosure:

FIGS. 9A and 9B show the same roll paper support device, wherein FIG. 9A is a side view showing the positional relationship between the interlocking members and the insertion part when the rotating members are in the unlocked position and FIG. 9B is a perspective view of FIG. 9A;

FIGS. 10A and 10B show the same roll paper support device, wherein FIG. 10A is a side view showing the positional relationship between the interlocking members and the insertion part when the rotating members are in the locked position and FIG. 10B is a perspective view of FIG. 10A.

DETAILED DESCRIPTION OF EXEMPLARY EMBODIMENTS

An embodiment in which the recording device of the present invention is specified as an inkjet printer is described hereinbelow based on the drawings. In the following description, unless otherwise specified, the terms "forward-backward direction," "up-down direction", and "left-right direction" refer to the "forward-backward direction," "up-down direction," and "left-right direction" shown by the arrows in FIG. 1. In the present embodiment, the up-down direction is defined as the same direction as the vertical direction (the direction of gravity).

Figure 1:
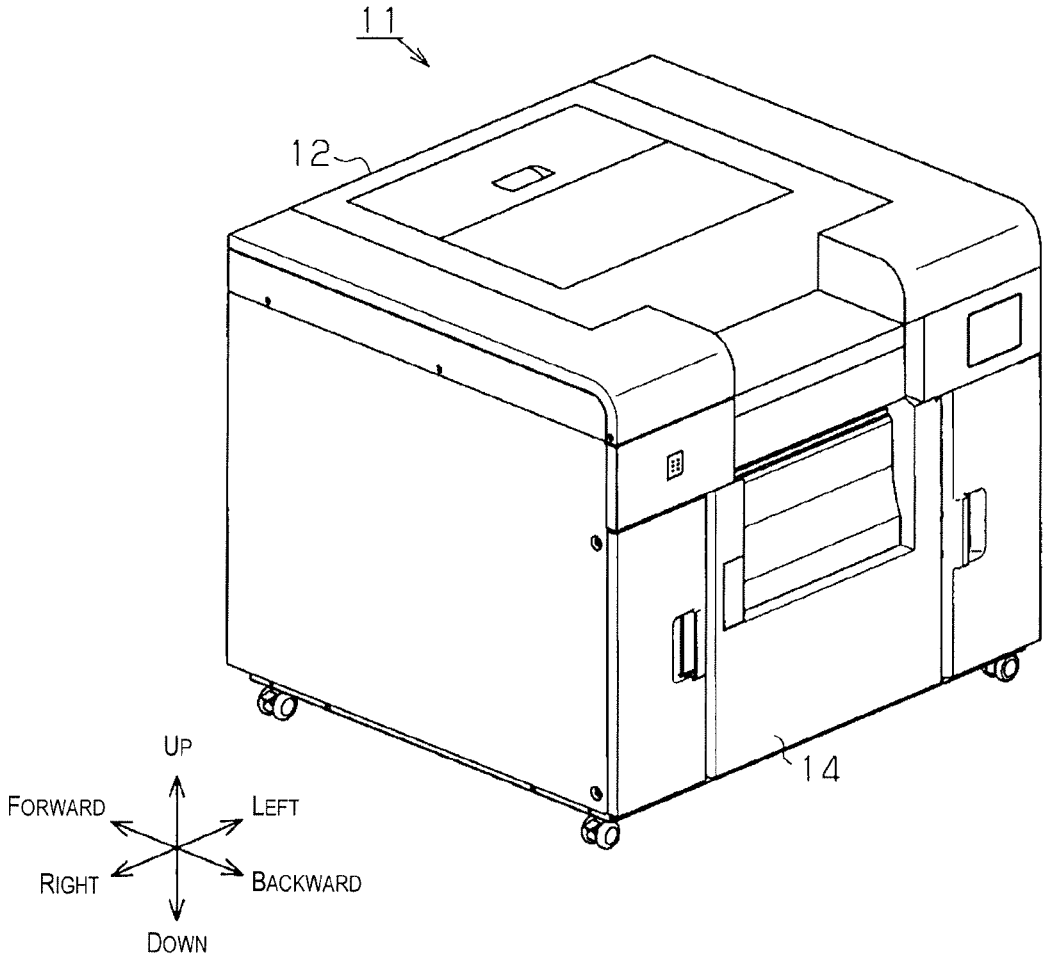
FIG. 1 is a perspective view of an inkjet printer in the embodiment.
Figure 2:
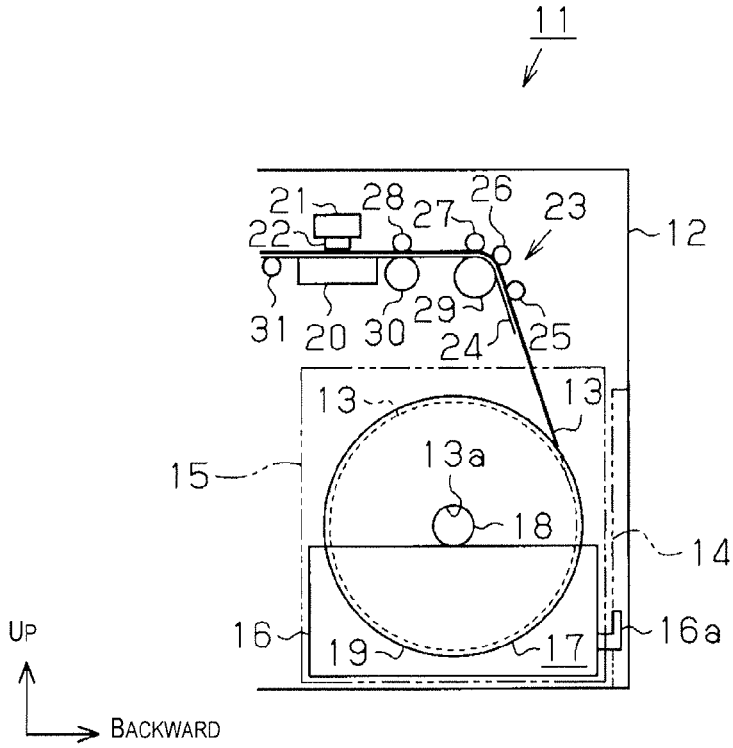
FIG. 2 is a schematic view showing a state when the roll paper has been set in the roll paper accommodating unit of the same printer.

An inkjet printer 11 as a recording device comprises a main frame 12 having a cuboid shape, as shown in FIGS. 1 and 2. The rear bottom part of the main frame 12 is provided with a door 14 which opens and closes when a roll paper 13 as a roll medium is set inside the main frame 12, and when the roll paper 13 sent inside the main frame 12 is replaced. Specifically, in a position at the bottom inside the main frame 12 and on the inner side of the door 14, a roll paper accommodating unit 15 is provided for accommodating the roll paper 13.

Figure 3:
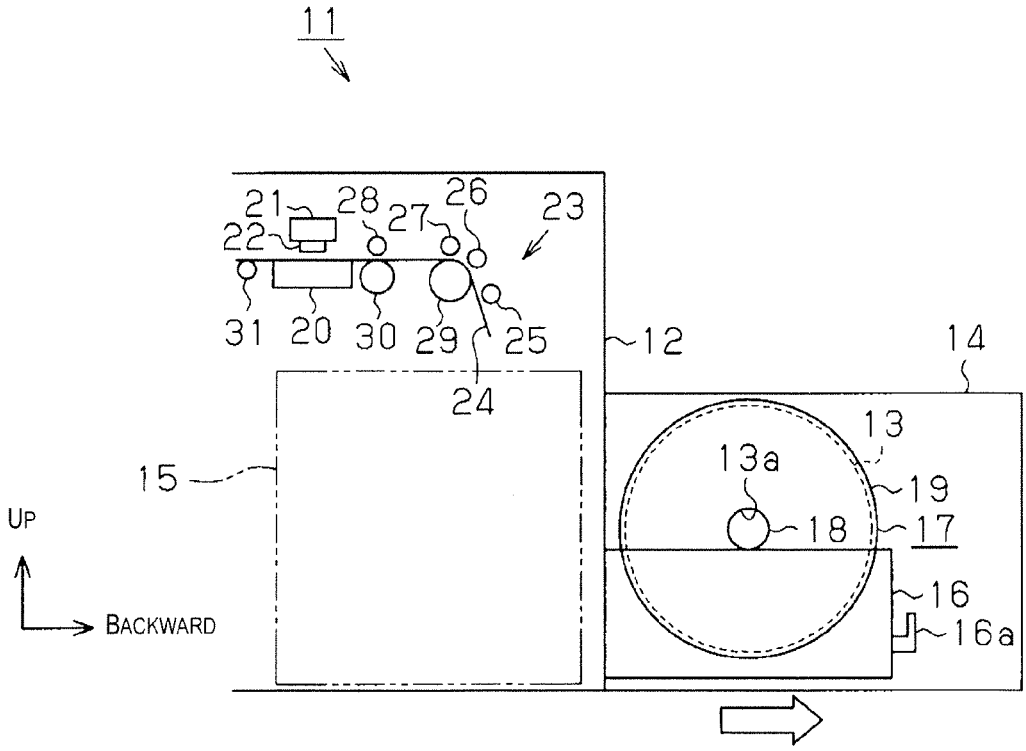
FIG. 3 is a schematic view showing a state when the roll paper has been pulled out of the roll paper accommodating unit of the same printer.

The roll paper accommodating unit 15 is provided with a drawer member 16 configured so as to be capable of sliding in the forward-backward direction (sliding direction) relative to the roll paper accommodating unit 15, as shown in FIGS. 2 and 3. Specifically, when the door 14 is open, the drawer member 16 can be pulled in and out of the roll paper accommodating unit 15. At the rear end bottom part of the drawer member 16, a handle 16*a* is provided for grasping when sliding the drawer member 16.

After the roll paper 13 has been supported via a roll paper support device 17 as a roll medium support device in the drawer member 16 while the drawer member 16 has been pulled out of the roll paper accommodating unit 15, when the drawer member 16 is then accommodated back in the roll paper accommodating unit 15, the roll paper 13 is supported in the roll paper accommodating unit 15 via the roll paper support device 17 so as to be capable of rotating around an axis line extending in the left-right direction.

The roll paper support device 17 comprises a shaft member 18 inserted through a center hole 13*a* of the roll paper 13, and a pair of flanges 19 as support members mounted to the shaft member 18 while the roll paper 13 is being supported from both sides in the width direction (the left-right direction). The shaft member 18 extends in the left-right direction, and the right end thereof is provided with a gear 18*a*, described hereinafter (see FIG. 4).

The position of the drawer member 16 when the drawer member 16 has been pulled out of the roll paper accommodating unit 15 (the position shown in FIG. 3) is designated as the pull-out position, and the position of the drawer member 16 when the drawer member 16 is accommodated in the roll paper accommodating unit 15 (the position shown in FIG. 2) is designated as the accommodated position.

In a position above the roll paper accommodating unit 15 inside the main frame 12, a flat plate-shaped platen 20 for supporting the roll paper 13 unreeled from the roll paper accommodating unit 15 is disposed in a horizontal state, as shown in FIGS. 2 and 3. A carriage 21 is provided above the platen 20 so as to face the platen 20, and a recording head 22 as recording unit is supported on the underside of the carriage 21. The carriage 21 is configured to be capable of being moved back and forth in the left-right direction by a drive unit (not shown), and ink is supplied to the recording head 22 from ink cartridges (not shown) disposed inside the main frame 12.

Inside the main frame 12 is provided a conveying mechanism 23 for conveying the roll paper 13 supported in the roll paper accommodating unit 15 over the platen 20 along a conveying route of the roll paper 13. The conveying mechanism 23 comprises a guide plate 24 for guiding the roll paper 13 unreeled from the roll paper accommodating unit 15 along the conveying route, and a plurality of conveying rollers 25 to 31 which are set up along the conveying route and which convey the roll paper 13 toward the platen 20.

While the roll paper 13 supported in the roll paper accommodating unit 15 is sequentially conveyed by the conveying mechanism 23 over the platen 20 and the carriage 21 is moved back and forth in the left-right direction by the drive unit (not shown), ink is ejected from the recording head 22 onto the roll paper 13 on the platen 20, whereby printing, a recording process, is performed on the roll paper 13. After being dried by a drying device (not shown) disposed downstream from the platen 20 in the conveying route, the roll paper 13 is sequentially wound up by a winding shaft (not shown).

Figure 4:
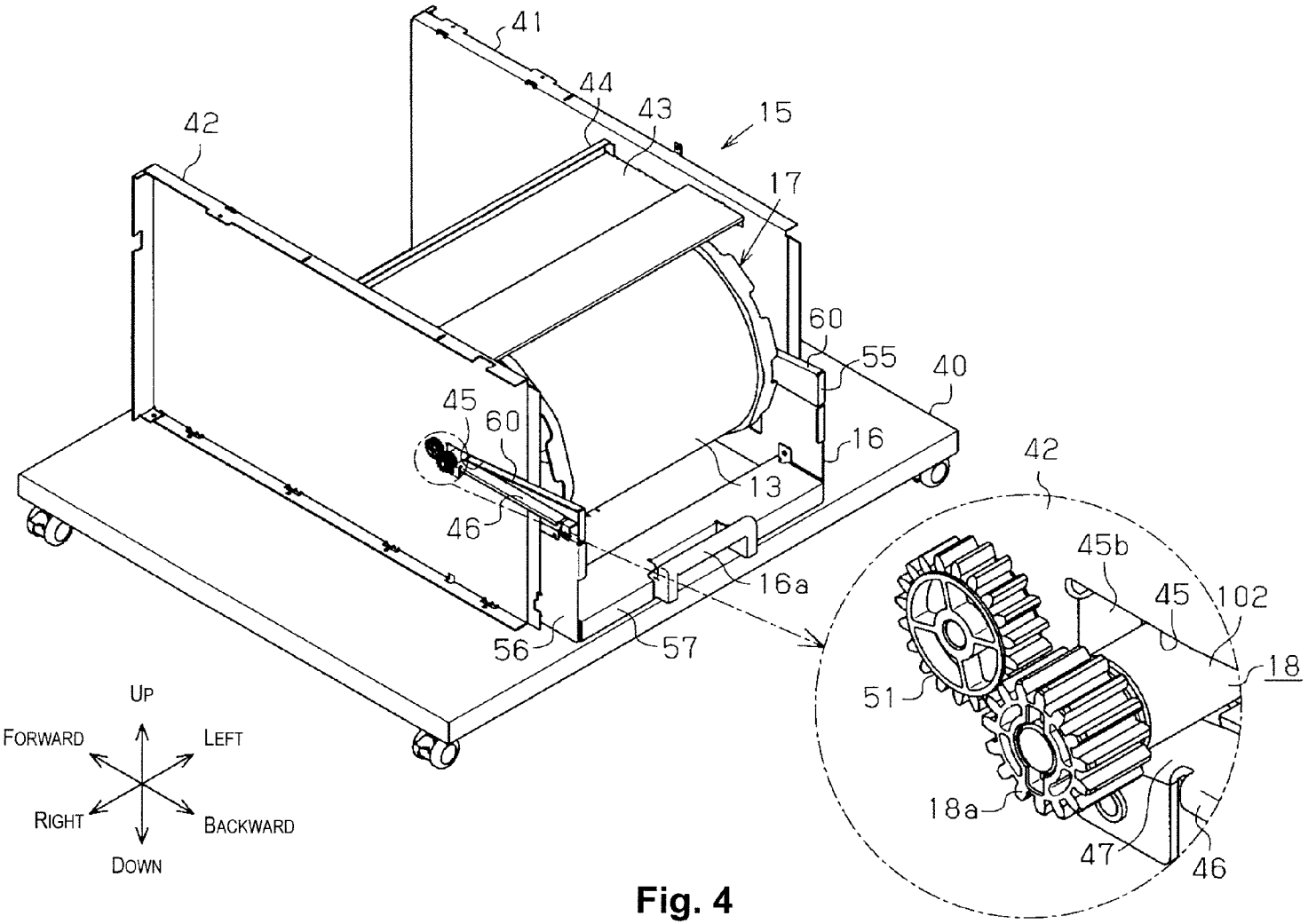
FIG. 4 is a perspective view of the roll paper accommodating unit in the same printer.

The roll paper accommodating unit 15 comprises accommodating unit side plates 41, 42 disposed on a flat plate-shaped base stand 40 of the main frame 12 (see FIG. 1) so as to face each other across a predetermined interval in the left-right direction, as shown in FIG. 4. A top plate 43 extends between the top ends of the accommodating unit side plates 41, 42, and a front plate 44 extends between the accommodating unit side plates 41, 42 so as to close up the opening enclosed by the front end edge of the top plate 43, the inside surfaces of the accommodating unit side plates 41, 42, and the top surface of the base stand 40.

In the vertical center of the rear end of the right accommodating unit side plate 42, a recessed groove 45 extending in the forward-backward direction is formed. The recessed groove 45 is opened in the rear end side and is closed off in the front end side. In the bottom surface of the recessed groove 45, the front end is inclined so as to lower toward the front, and the rest of the bottom surface other than the front end extends horizontally.

A front surface 45*b* of the recessed groove 45 extends in the up-down direction, and the top surface of the recessed groove 45 extends at an incline so as to rise upward toward the rear. On the bottom surface of the recessed groove 45, a belt-shaped support plate 46 extending in the forward-backward direction along the bottom surface is provided so as to cover the bottom surface.

The support plate 46 is provided in the front end with a front inclined part 47 which is inclined along the incline of the front end in the bottom surface of the recessed groove 45, and the rear end protrudes backward from the opening in the rear end of the recessed groove 45. The rear end of the support plate 46 inclines so as to rise upward toward the rear, and then extends horizontally straight to the rear.

In the inside surface (the right surface) of the left accommodating unit side plate 41, a support plate 46 identical to the one described above is provided so as to correspond to the support plate 46 of the right accommodating unit side plate 42. Furthermore, the inside surface (the right surface) of the left accommodating unit side plate 41 is provided with a contact member (not shown) having a contact surface which corresponds with the front surface 45*b* of the recessed groove 45.

In a position which is forward-adjacent to the front surface 45*b* of the recessed groove 45 in the top of the outside surface (the right surface) of the right accommodating unit side plate 42, a drive gear 51 is turnably supported to be capable of being rotatably driven in two directions around an axis line extending in the left-right direction by a motor (not shown) provided inside the main frame 12. In a state in which the drawer member 16 is in the accommodated position, i.e. a state in which the shaft member 18 inserted through the center hole 13*a* of the roll paper 13 is supported by the front inclined part 47 of the support plate 46 and the front surface 45*b* of the recessed groove 45, the gear 18*a* provided to the right end of the shaft member 18 and the drive gear 51 mesh together on the outer side (the right side) of the right accommodating unit side plate 42.

The drawer member 16 comprises pair of rectangular drawer side plates 55, 56 disposed so as to face each other across a predetermined interval in the left-right direction, and cuboid frame 57 extending between the bottom ends in the rear ends of the drawer side plates 55, 56, as shown in FIG. 4. The width between the drawer side plates 55, 56 is slightly less than the width between the accommodating unit side plates 41, 42. Therefore, the drawer member 16 can be inserted between the accommodating unit side plates 41, 42 from the rear. The top surfaces of the drawer side plates 55, 56 are drawer inclined surfaces 60 inclined so as to lower toward the front.

Next, the configuration of the roll paper support device 17 will be described in detail.

Figure 5:
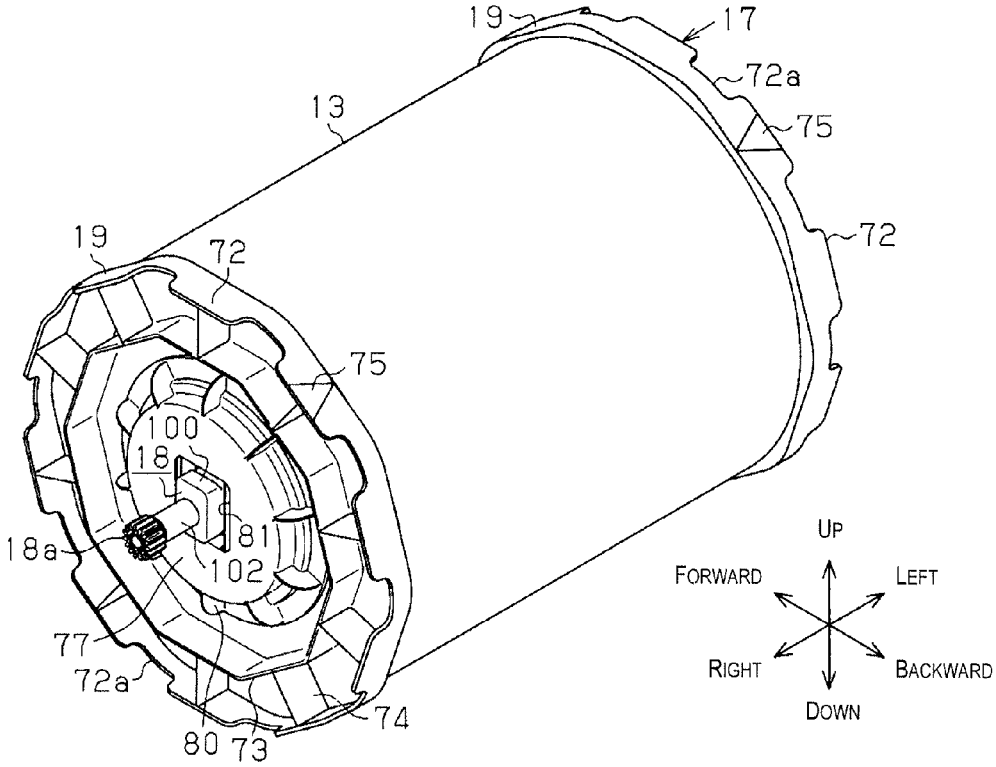
FIG. 5 is a perspective view showing a state when roll paper is supported in the roll paper support device used in the same printer.
Figure 7:
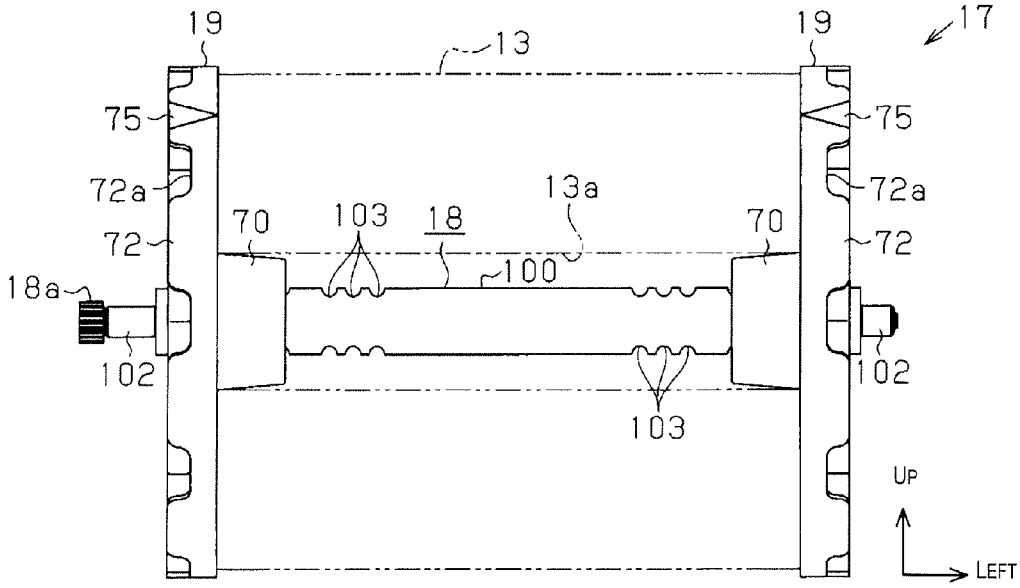
FIG. 7 is a rear view of the same roll paper support device.

The roll paper support device 17 comprises a shaft member 18 inserted through the center hole 13*a* of the roll paper 13, and a pair of flanges 19 mounted to the shaft member 18 in a state of supporting the roll paper 13 from both sides in the left-right direction (the width direction), as shown in FIGS. 5 and 7.

Figure 6:
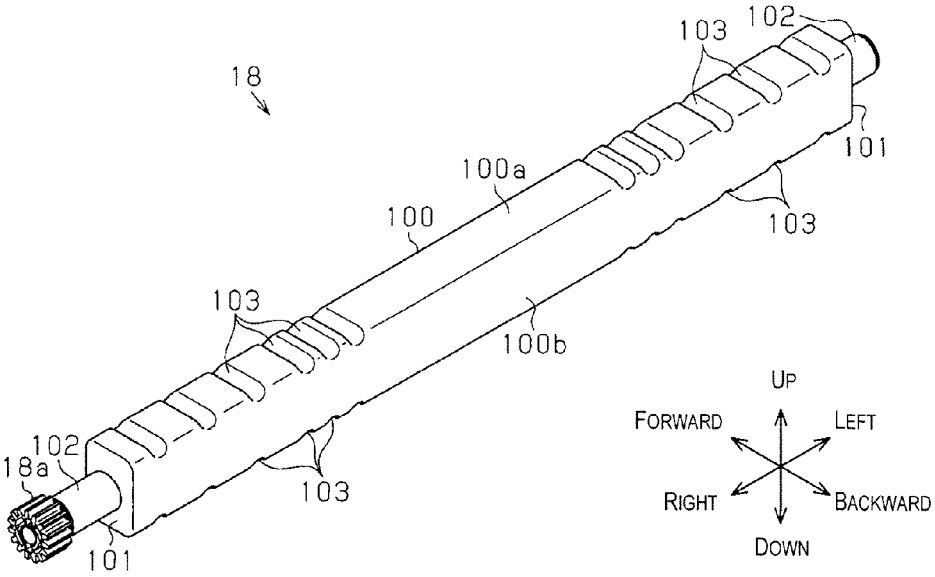
FIG. 6 is a perspective view of a shaft member in the same roll paper support device.

The shaft member 18 comprises an insertion part 100 having a rectangular shape in cross section which is longer than the width of the roll paper 13 at maximum width and which is slightly shorter than the distance between the drawer side plates 55, 56 (see FIG. 4) in the left-right direction, and pillar-shaped shafts 102 extending along the left-right direction in the centers of left and right end surfaces 101 of the insertion part 100, as shown in FIG. 6. The outside diameter of the shaft 102 is designed to be shorter than the distance between the long-side surfaces 100*b* of the insertion part 100.

The gear 18*a* is provided to the distal end of the right shaft 102 in the shaft member 18. The width of the insertion part 100 in the left-right direction is greater than the width in the up-down direction. Specifically, the top and bottom surfaces of the insertion part 100 constitute short-side surfaces 100*a*, and the left and right surfaces constitute the long-side surfaces 100*b*.

To the left and right sides of the left-right centers of the short-side surfaces 100*a* of the insertion part 100, six pairs of U-shaped concave grooves 103 as concave parts extending in the forward-backward direction are formed in both the top and bottom so as to constitute pairs in the left-right direction. The left and right six pairs of concave grooves 103 in the insertion part 100 are aligned in parallel with each other in the left-right direction. The insertion part 100 has a shape which is plane-symmetric about a plane that bisects the insertion part 100 to the left and right, and is also plane-symmetric about a plane that bisects the insertion part 100 up and down.

Figure 8:
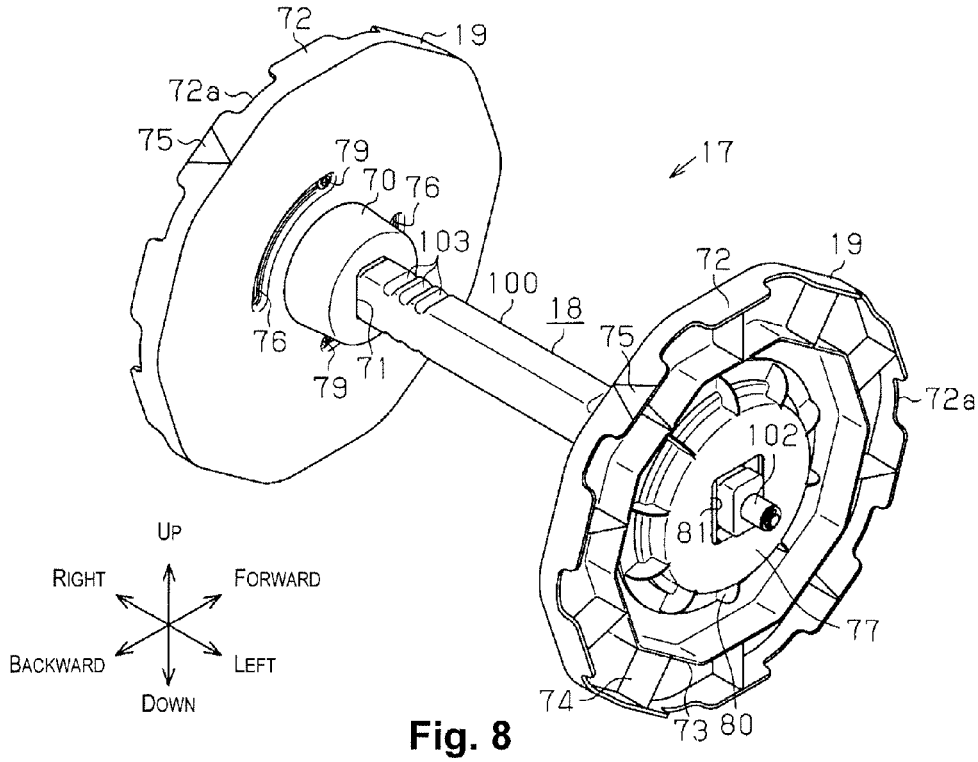
FIG. 8 is a perspective view of the same roll paper support device.

The flanges 19 are shaped as regular decagons and are made to face each other in the left-right direction, as shown in FIGS. 5, 7, and 8. The flanges 19 are configured so that the diameters of their inscribed circles are greater than the outside diameter of the roll paper 13. In the centers of the inside surfaces of the flanges 19, fitting parts 70, which fit into the center hole 13*a* of the roll paper 13, protrude inward.

The fitting parts 70 are substantially pillar-shaped, and their outside diameters gradually decrease toward the distal ends. First insertion holes 71 having rectangular shapes elongated vertically are formed in the centers of the flanges 19 so as to pass through the fitting parts 70 to the left and right. The first insertion holes 71 are designed so as to be just large enough for the insertion part 100 of the shaft member 18 to be inserted through.

In the peripheral edges in the outside surfaces of the flanges 19 (the surface on the opposite side of the surface facing the other flange 19), annular peripheral walls 72 protrude outward along the peripheral edges. Recessed parts 72*a* are formed in portions of the peripheral walls 72 corresponding to the tips of the flanges 19 (in ten locations in the present embodiment).

In the inner sides of the peripheral walls 72 on the outside surfaces of the flanges 19, annular ribs 73 in the shapes of regular decagons protrude so as to correspond with the peripheral walls 72. Furthermore, between the peripheral walls 72 and the annular ribs 73 in the outside surfaces of the flanges 19, a plurality (ten in the present embodiment) of connecting ribs 74 protrude outward so as to connect the centers of every edge of the peripheral walls 72 with the centers of every edge of the annular ribs 73.

Triangular markings 75 are formed in upper right parts of the outside surfaces (the peripheral surfaces) of the peripheral walls 72 of the flanges 19. When the flanges 19 are disposed facing each other so that their respective markings 75 correspond to each other, their phases in the peripheral direction coincide. Specifically, when the flanges 19 are disposed facing each other so that their respective markings 75 correspond to each other, their respective first insertion holes 71 coincide in the left-right direction.

In the inner sides of the annular ribs 73 in the outside surfaces of the flanges 19, a pair of guide holes 76 which have arcs of 90 degrees and face each other from either side of the centers of the flanges 19 are formed so as to pass through the annular ribs 73. The guide holes 76 are formed so as to be respectively positioned above and to the rear, and below and to the front, of the centers of the flanges 19. The ends of the guide holes 76 overlap each other in the up-down direction and in the forward-backward direction.

Furthermore, on the inner sides of the annular ribs 73 in the outside surfaces of the flanges 19, round rotating members 77 having a certain depth are provided to be capable of rotating relative to the flanges 19. The rotational centers of the rotating members 77 coincide with the centers of the flanges 19 in the left-right direction, and spaces are formed with the outside surfaces of the flanges 19. The top and bottom ends in the inner sides of the rotating members 77 are provided with attachment parts 78 (see FIG. 9B), each having screw holes (not shown).

The rotating members 77 are mounted to the flanges 19 by a pair of flange screws 79 being passed through the guide holes 76 from the inner sides of the flanges 19 and threaded into the screw holes of the attachment parts 78 of the rotating members 77. In this case, the flange screws 79 are designed so that the outside diameters of the flange portions are greater than the widths of the guide holes 76, and the outside diameters of the shaft portions are less than the widths of the guide holes 76.

Furthermore, the strength with which the rotating members 77 are fastened in the screw holes of the attachment parts by the flange screws 79 is designed so as to not impede the rotating action of the rotating members 77 relative to the flanges 19. Therefore, when the rotating members 77 are turned relative to the flanges 19, the flange screws 79 slide along the guide holes 76. Therefore, in the present embodiment, the rotatable range of the rotating members 77 relative to the flanges 19 is limited to a range of 0 to 90 degrees by the guide holes 76. The outside peripheral edges in the rotating members 77 have pluralities of peripheral ribs 80 provided in radial fashion at equal intervals along the peripheries.

Figure 9A:
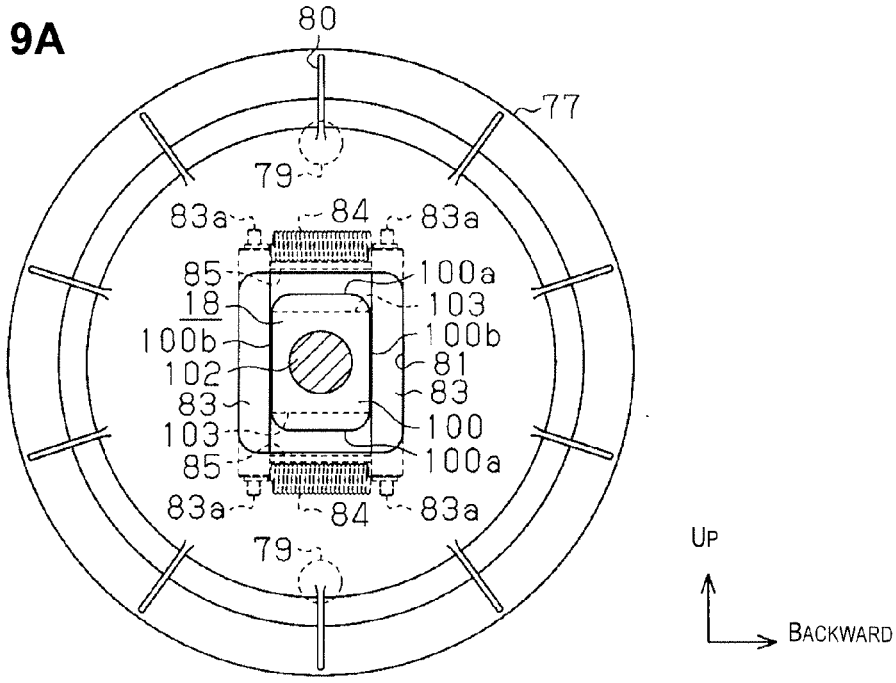
Figure 9B:
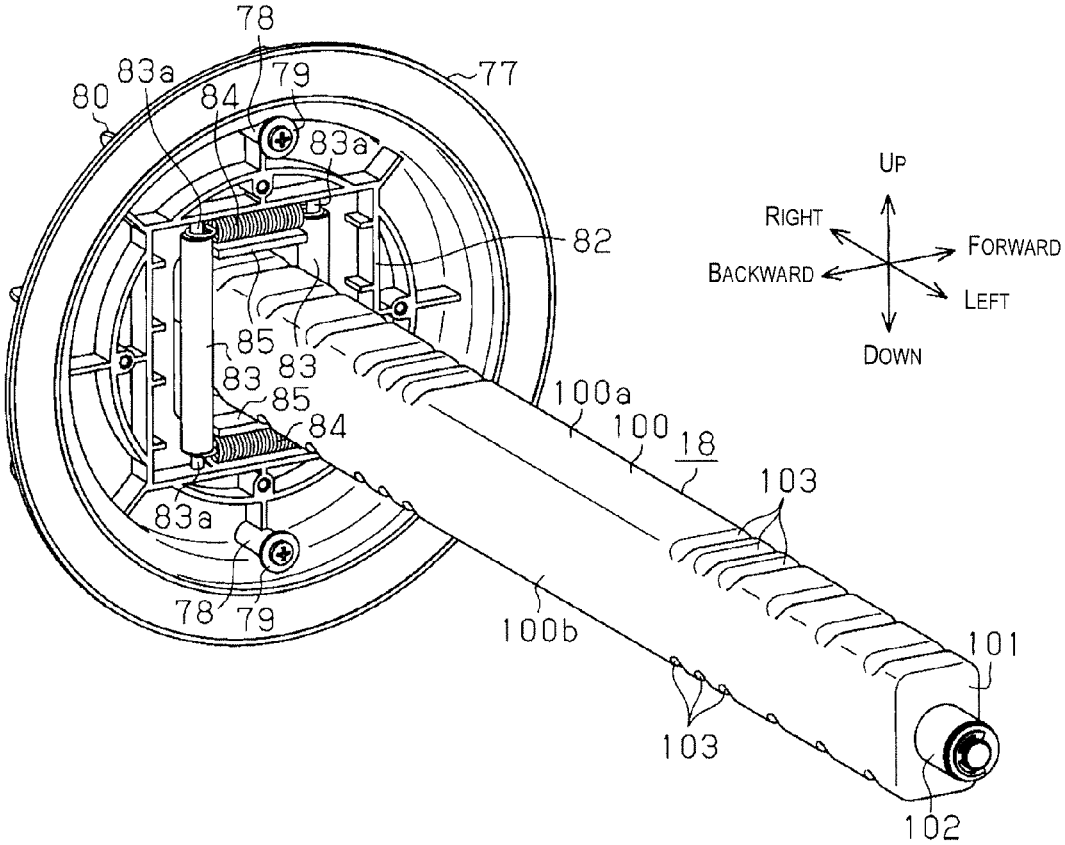

In the centers of the rotating members 77, second insertion holes 81 having vertically elongated rectangular shapes are formed so as to pass through as shown in FIGS. 9A and 9B. The short sides of the second insertion holes 81 (the distances in the forward-backward direction in FIG. 9A) are longer than the distance between the short-side surfaces 100*a* of the insertion part 100 of the shaft member 18. In the inner sides of the rotating members 77, square frames 82 are formed so as to enclose the second insertion holes 81.

Inside the frames 82 are disposed pairs of columnar interlocking members 83 which extend along the long sides of the second insertion holes 81 and which are capable of engaging with the concave grooves 103 of the insertion part 100 of the shaft member 18. The interlocking members 83 are longer than the long sides of the second insertion holes 81, and protuberances 83*a* are provided at both ends of each of the interlocking members 83. Inside the frames 82, the top protuberances 83*a* of the interlocking members 83 are joined together and the bottom protuberances 83*a* are joined together, each via one of a pair of coil springs 84 (tension springs) as urging members and elastic members. Specifically, the coil springs 84 join together the protuberances 83*a* of the interlocking members 83 that face each other in the forward-backward direction and urge the interlocking members 83 towards each other.

Also inside the frames 82 are provided a pair of plate-shaped spacers 85 which extend along the short sides of the second insertion holes 81 and which are intended to maintain a minimum distance between the interlocking members 83. Specifically, the spacers 85 are positioned between the interlocking members 83 and also between the second insertion holes 81 and the coil springs 84. The length of the spacers 85 in the forward-backward direction is slightly longer than the distance between the long-side surfaces 100*b* of the insertion part 100 of the shaft member 18. Therefore, the forward and backward ends of the second insertion holes 81 are covered from the inside by the interlocking members 83.

In this case, the distance between the interlocking members 83 is equal to the length of the spacers 85 in the forward-backward direction. Specifically, the distance between the interlocking members 83 is shorter than the distance between the short-side surfaces 100*a* of the insertion part 100 of the shaft member 18, and longer than the distance between the long-side surfaces 100*b* of the insertion part 100 of the shaft member 18. In the present embodiment, the roll paper support device 17 is configured by the shaft member 18, the flanges 19, the rotating members 77, the interlocking members 83, and the coil springs 84.

Next, the action of supporting the roll paper 13 in the roll paper support device 17 will be described.

When the roll paper 13 is supported in the roll paper support device 17, first, the left end of the insertion part 100 of the shaft member 18 is inserted through the first insertion hole 71 of the left flange 19 and the second insertion hole 81 of the rotating member 77 from the inner side of the flange 19. At this time, the rotating member 77 is in an unlocked position (the position shown in FIG. 9B), which is a position in which the interlocking members 83 extend in the up-down direction. When the rotating member 77 is in the unlocked position, the flange 19 can easily slide without a load along the insertion part 100.

Figure 10A:
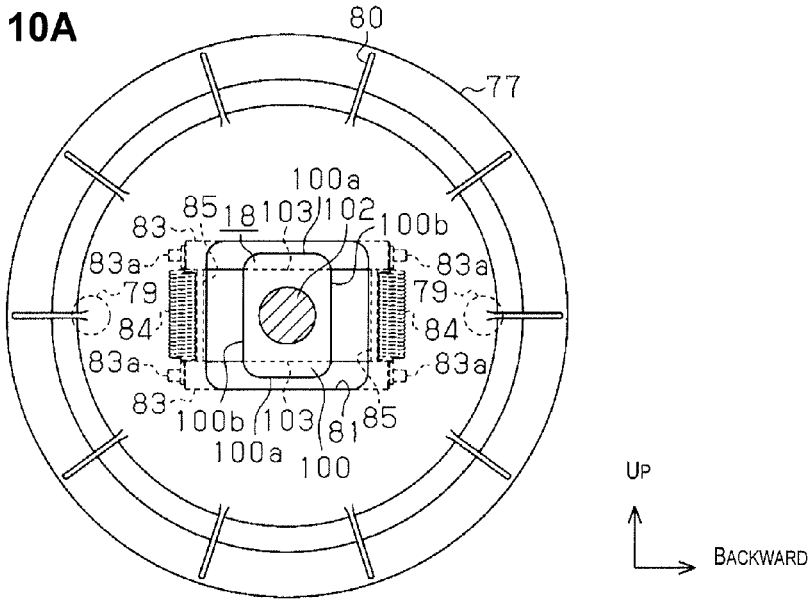
Figure 10B:
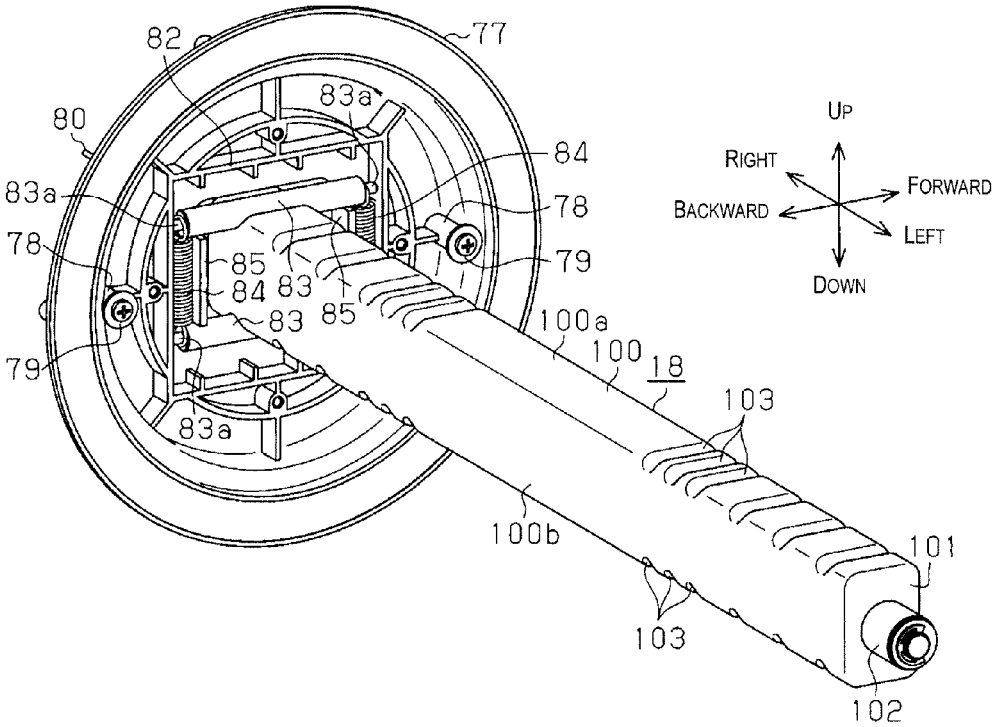

Next, in the side of the insertion part 100 to the left of the left-right center, the interlocking members 83 are lined up with a pair of upper and lower concave grooves 103 selected from the six pairs of upper and lower concave grooves 103 on the left side of the insertion part 100, so that the left flange 19 is in a position conforming to the width of the roll paper 13 that will next be used. When the rotating member 77 is gradually rotated in this state, the distance between the interlocking members 83 is increased by the insertion part 100 against the urging force of the coil springs 84, and when the rotating member 77 has rotated 90 degrees, the interlocking members 83 engage with the aforementioned selected pair of upper and lower concave grooves 103 due to the urging force of the coil springs 84, as shown in FIGS. 10A and 10B. Specifically, the interlocking members 83 press in on the insertion part 100 in the aforementioned selected pair of upper and lower concave grooves 103 due to the urging force of the coil springs 84.

At this time, the rotating member 77 is in a locked position (the position shown in FIG. 10B), which is a position in which the interlocking members 83 extend in the forward-backward direction. When the rotating member 77 is in the locked position, the flange 19 is fixed in place on the insertion part 100 via the rotating member 77 and the interlocking members 83. Next, the insertion part 100 of the shaft member 18 is inserted through the center hole 13*a* of the roll paper 13 from the right end and the fitting part 70 of the left flange 19 already fixed on the insertion part 100 is fitted into the center hole 13*a*.

The center position of the roll paper 13 is thereby lined up with the center position of the insertion part 100 in the left-right direction. Next, the right end of the insertion part 100 of the shaft member 18 is inserted through the first insertion hole 71 of the right flange 19 and the second insertion hole 81 of the rotating member 77 from the inside of the flange 19, in the same manner as described above. At this time, by lining up the markings 75 of the right flange 19 with the markings 75 on the left, the right end of the insertion part 100 of the shaft member 18 can easily be inserted through the first insertion hole 71 of the right flange 19 and the second insertion hole 81 of the rotating member 77 without the need for visual confirmation from the left-right direction.

Next, the right flange 19 is slid to the left along the insertion part 100 and the fitting part 70 of the flange 19 is fitted into the center hole 13*a* of the roll paper 13. A state is thereby created in which, among the six pairs of upper and lower concave grooves 103 on the right side of the insertion part 100, the positions of the interlocking members 83 of the rotating member 77 of the right flange 19 are lined up with the upper and lower pair of concave grooves 103 that are symmetrical about the left-right center of the insertion part 100 with the upper and lower pair of concave grooves 103 that are engaged with the interlocking members 83 of the rotating member 77 of the left flange 19.

When the rotating member 77 is rotated gradually in this state, the distance between the interlocking members 83 is increased by the insertion part 100 against the urging force of the coil springs 84 in the same manner as described above, and when the rotating member 77 has rotated 90 degrees, the interlocking members 83 engage with the corresponding pair of upper and lower concave grooves 103 due to the urging force of the coil springs 84, as shown in FIGS. 10A and 10B. Specifically, the interlocking members 83 press in on the insertion part 100 in the aforementioned corresponding pair of upper and lower concave grooves 103 due to the urging force of the coil springs 84.

At this time, since the rotating member 77 is in the locked position, the right flange 19 is fixed on the insertion part 100 via the rotating member 77 and the interlocking members 83. A state is thereby created in which the roll paper 13 is held on both sides from the width direction (the left-right direction) by the flanges 19, i.e., the roll paper 13 is supported in the roll paper support device 17.

When the roll paper 13 supported in the roll paper support device 17 is replaced with another roll paper 13, the flanges 19 are removed from the shaft member 18 in a state in which the rotating members 77 of the flanges 19 have been rotated from the locked position to the unlocked position. After the shaft member 18 has been taken out of the center hole 13*a* of the roll paper 13 that was being used up to this point, the roll paper 13 that will be used hereafter is preferably supported in the roll paper support device 17 in the same manner as described above.

The following is a description of the action of setting the roll paper support device 17 supporting the roll paper 13 into the roll paper accommodating unit 15 of the inkjet printer 11.

When the roll paper support device 17 supporting the roll paper 13 is set into the roll paper accommodating unit 15, the drawer member 16 is first pulled out of the roll paper accommodating unit 15. In this state, the shaft member 18 of the roll paper support device 17 is placed in the drawer member 16 so as to extend between the drawer side plates 55, 56. Specifically, the shafts 102 of the shaft member 18 are placed on the drawer inclined surfaces 60 of the drawer side plates 55, 56, and the flanges 19 are inserted in between the drawer side plates 55, 56.

Figure 11:
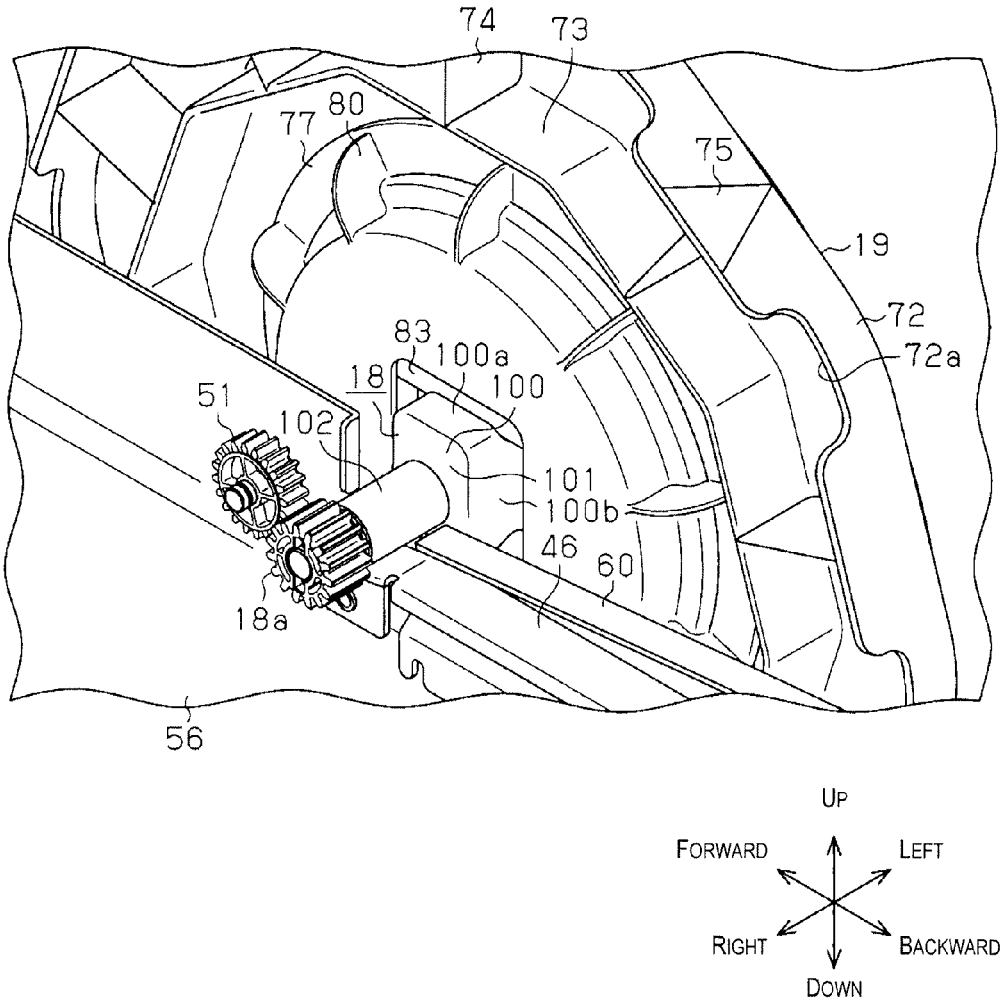
FIG. 11 is a partial enlarged perspective view showing a state when the roll paper support device supporting the roll paper is set into the roll paper accommodating unit of the printer of the embodiment.

Next, when the drawer member 16 is accommodated in the roll paper accommodating unit 15, the roll paper support device 17 supporting the roll paper 13 is set into a predetermined position in the roll paper accommodating unit 15 (the position shown in FIG. 4), and the gear 18*a* of the shaft member 18 meshes with the drive gear 51. At this time, left and right end surfaces 101 of the insertion part 100 of the shaft member 18 face the inside surfaces of the drawer side plates 55, 56 while in close proximity to the inside surfaces, as shown in FIGS. 4 and 11.

When the drive gear 51 is driven, the rotational drive force is transmitted from the gear 18*a* to the roll paper support device 17 and the roll paper support device 17 rotates integrally with the roll paper 13, whereby the roll paper 13 is fed toward the platen 20. At this time, in cases in which the roll paper support device 17 acts as though to move in the left-right direction during rotation, the position of the roll paper support device 17 is prevented from deviating in the left-right direction because the left and right end surfaces 101 of the insertion part 100 of the shaft member 18 come in contact with the inside surfaces of the drawer side plates 55, 56. Therefore, the left and right end surfaces 101 of the insertion part 100 of the shaft member 18 function as a movement regulation unit for regulating the movement of the roll paper support device 17 in the left-right direction.

According to the embodiment described in detail above, the following effects can be achieved.

(1) The distance between the interlocking members 83 of the rotating members 77 is shorter than the distance between the short-side surfaces 100*a* of the insertion part 100 of the shaft member 18 and longer than the distance between the long-side surfaces 100*b* of the insertion part 100. Therefore, when the insertion part 100 of the shaft member 18 is inserted through the second insertion holes 81 of the rotating members 77 while the rotating members 77 are in the unlocked position, the urging force of the coil springs 84 is prevented from imposing a load. Additionally, when the rotating members 77 are rotated from the unlocked position to the locked position in a state in which the flanges 19 have been slid along the insertion part 100 so as to align with the width of the roll paper 13, the interlocking members 83 press in on the short-side surfaces 100*a* of the insertion part 100 at the concave grooves 103 due to the urging force of the coil springs 84, and the flanges 19 can therefore be easily fixed in place at the positions in the insertion part 100 where the concave grooves 103 are formed. Therefore, it is possible to improve the operability when varying the positions of the flanges 19 which are attached to the insertion part 100 of the shaft member 18 and which support the roll paper 13 from the width direction.

(2) Concave grooves 103 capable of engaging with the interlocking members 83 are formed in the short-side surfaces 100*a* of the insertion part 100 of the shaft member 18. Therefore, by rotating the rotating members 77 from the unlocked position to the locked position in a state in which the flanges 19 have been moved so that the interlocking members 83 correspond with the concave grooves 103 of the insertion part 100, the interlocking members 83 can be engaged while pressing against the concave grooves 103 of the insertion part 100 due to the urging force of the coil springs 84. Therefore, the flanges 19 can be effectively prevented from moving in the axial direction (the left-right direction) along the insertion part 100 of the shaft member 18.

(3) Since the opposing protuberances 83*a* of the interlocking members 83 are joined together by the coil springs 84 (the tension springs), the interlocking members 83 can be urged towards each other with a simple structure.

(4) Since the flanges 19 of the roll paper support device 17 have regular decagon shapes, the roll paper support device 17 supporting the roll paper 13 is impeded from rolling even when placed on a flat floor surface.

(5) On the outside surfaces of the peripheral walls 72 of the flanges 19 are formed markings 75 for disposing the flanges 19 facing each other so that the first insertion holes 71 of the flanges 19 coincide with each other in the left-right direction (the width direction of the roll paper 13). Therefore, by lining up the markings 75 of the flanges 19 with each other, the flanges 19 can easily be disposed facing each other so that the first insertion holes 71 of the flanges 19 coincide with each other in the left-right direction. Therefore, even if it is not visible from the left-right direction, the insertion part 100 of the shaft member 18 can easily be inserted through the first insertion holes 71 of the flanges 19 and the second insertion holes 81 of the rotating members 77.

(6) In the centers of the left and right end surfaces 101 of the insertion part 100 of the shaft member 18, the axially supporting shafts 102 extend along the left-right direction (the axial direction). In a state in which the roll paper support device 17 supporting the roll paper 13 has been set into the roll paper accommodating unit 15, the shafts 102 of the shaft member 18 are axially supported by the support plates 46 and other components and the left and right end surfaces 101 of the insertion part 100 of the shaft member 18 face the inside surfaces of the drawer side plates 55, 56 while in close proximity to the inside surfaces. Therefore, in cases in which the roll paper support device 17 acts as though to move in the left-right direction during rotation, the position of the roll paper support device 17 is prevented from deviating in the left-right direction because the left and right end surfaces 101 of the insertion part 100 of the shaft member 18 come in contact with the inside surfaces of the drawer side plates 55, 56.

(7) Since the first insertion holes 71 of the flanges 19 are rectangular shaped and the insertion part 100 of the shaft member 18 has a rectangular shape corresponding with the shape of the first insertion holes 71 in cross section, the insertion part 100 of the shaft member 18 can be prevented from being inserted through the first insertion holes 71 with an incorrect orientation.

Modifications

The embodiment described above may be modified in the following manner.

The shafts 102 may be omitted from the shaft member 18. In this case, the roll paper accommodating unit 15 must be configured to be capable of rotatably supporting both ends of the insertion part 100 of the shaft member 18.

The markings 75 provided to the flanges 19 may be written with writing materials, paint, or the like, the markings may be adhered labels, or the markings may be notches, holes, protuberances, concavities, or the like formed in the flanges.

The shapes of the flanges 19 may be regular polyhedra other than regular decagons (regular hexagons, regular octagons, or the like), or they may be simple polygons, circles, or ellipses.

Rubber may be used as elastic members instead of the coil springs 84.

Actuators may be used as urging members instead of the coil springs 84.

The concave grooves 103 of the insertion part 100 of the shaft member 18 may be omitted.

The gear 18*a* of the shaft member 18 and the drive gear 51 may be omitted.

Circular or prismatic column-shaped members having a certain thickness may be used as support members instead of the flanges 19.

Rolled plastic film, rolled cloth, rolled metal foil, and other roll media may be used instead of the roll paper 13.

In the embodiment described above, the recording device is specified as an inkjet printer 11, but a recording device which ejects or discharges another liquid other than ink may also be used. The recording device can be applied in various liquid ejection devices which comprise a liquid ejection head or the like for discharging extremely small droplets. The term "droplets" refers to the state of the liquid discharged from the liquid ejection device, and includes that which leaves trails of grains, tears, or threads. The liquid referred to herein need only be a substance that can be ejected by the liquid ejection device. For example, the material need only be in the state of a liquid which includes not only fluids such as liquids of high and low viscosity, sols, gels, other inorganic solvents, organic solvents, solutions, liquid resins, and liquid metals (metal melts); and liquids as one state of the substance; but also includes liquids containing particles of functional materials composed of pigments, metal particles, or the like which are dissolved, dispersed, or mixed in a solvent. Typical examples of the liquids include ink such as the ink described in the embodiment described above, liquid crystal, and the like. The term "ink" used herein includes common water-based ink and oil-based ink, as well as gel ink, hot melt ink, and other various liquid compositions. Specific examples of the liquid ejection device include liquid ejection devices which eject a liquid containing an electrode material, a coloring material, or the like in the form of a dispersion or a solvent, which is used in the manufacture of liquid crystal displays, EL (electroluminescence) displays, surface-emitting displays, color filters, and the like, for example; liquid ejection devices which eject a biological organic substance used to manufacture biochips; liquid ejection devices which are used as precision pipettes and which eject a liquid as a test sample; printing devices, micro dispensers; and the like. Further options which may be used include liquid ejection devices which eject lubricating oil at pinpoints onto watches, cameras, and other precision instruments; liquid ejection devices for ejecting an ultraviolet curing resin or another transparent resin liquid onto a substrate in order to form a microscopic semispherical lens (optical lens) or the like used in an optical communication element or the like; and liquid ejection devices for ejecting an acid, an alkali, or another etching liquid in order to etch a substrate or the like. The present invention can be applied to any one of these types of liquid ejection devices.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A roll medium support device comprising:

a shaft member including an insertion part having a rectangular shape in cross section taken along a plane perpendicular to a longitudinal axis of the shaft member, the insertion part being configured to be inserted through a center hole of a roll medium, the rectangular shape being defined by a pair of long sides and a pair of short sides that are shorter than the long sides;

a support member having a rectangular first insertion hole through which the insertion part is inserted along an insertion direction so that the support member supports the roll medium from a width direction of the roll medium, a rectangular shape of the first insertion hole being defined on a plane perpendicular to the insertion direction by a pair of first long sides and a pair of first short sides that are shorter than the first long sides;

a rotating member rotatably provided to the support member and having a rectangular second insertion hole through which the insertion part is inserted along the insertion direction, a rectangular shape of the second insertion hole being defined on a plane perpendicular to the insertion direction by a pair of second long sides and a pair of second short sides that are shorter than the second long sides;

a pair of interlocking members extending along the second long sides of the second insertion hole in the rotating member, a distance between the interlocking members being shorter than a distance between short-side surfaces of the insertion part and longer than a distance between long-side surfaces of the insertion part; and an urging member urging the interlocking members towards each other.

2. The roll medium support device according to claim 1, wherein the insertion part of the shaft member includes concave parts formed in the short-side surfaces to engage with the interlocking members.

3. A recording device comprising:

the roll medium support device according to claim 2; and a recording unit configured to perform a recording process on the roll medium fed out from the roll medium support device.

4. The roll medium support device according to claim 1, wherein the urging member includes a pair of elastic members extending along the second short sides of the second insertion hole in the rotating member to connect opposing ends of the interlocking members together.

5. A recording device comprising:

the roll medium support device according to claim 4; and a recording unit configured to perform a recording process on the roll medium fed out from the roll medium support device.

6. The roll medium support device according to claim 1, wherein the support member includes a pair of polygonal flanges configured to support the roll medium from both sides in the width direction, and peripheral surfaces of the flanges include markings for disposing the flanges facing each other so that the first insertion holes formed in centers of the flanges align with each other in the width direction of the roll medium.

7. A recording device comprising:

the roll medium support device according to claim 6; and a recording unit configured to perform a recording process on the roll medium fed out from the roll medium support device.

8. The roll medium support device according to claim 1, wherein the shaft member further includes shaft portions configured to be axially supported, the shaft portions extending along an axial direction in centers at both ends in the axial direction of the insertion part.

9. A recording device comprising:

the roll medium support device according to claim 8; and a recording unit configured to perform a recording process on the roll medium fed out from the roll medium support device.

10. A recording device comprising:

the roll medium support device according to claim 1; and a recording unit configured to perform a recording process on the roll medium fed out from the roll medium support device.

* * * * *